US009981800B2

(12) United States Patent
Ryan et al.

(10) Patent No.: US 9,981,800 B2
(45) Date of Patent: May 29, 2018

(54) CARBON FILLED PRESSURIZED CONTAINER AND METHOD OF MAKING SAME

(75) Inventors: Thomas Anthony Ryan, Cheshire (GB); Harry Sharrock, Lancashire (GB); Neil D. Townend, Conwy (GB)

(73) Assignee: CALGON CARBON CORPORATION, Pittsburgh, PA (US)

( * ) Notice: Subject to any disclaimer, the term of this patent is extended or adjusted under 35 U.S.C. 154(b) by 1643 days.

(21) Appl. No.: 11/943,865

(22) Filed: Nov. 21, 2007

(65) Prior Publication Data

US 2008/0116228 A1 May 22, 2008

Related U.S. Application Data

(60) Provisional application No. 60/866,879, filed on Nov. 22, 2006.

(51) Int. Cl.

| | |
|---|---|
| ***B67D 7/60*** | (2010.01) |
| ***G01F 11/00*** | (2006.01) |
| ***B65D 83/64*** | (2006.01) |
| ***B65D 83/62*** | (2006.01) |

(52) U.S. Cl.

CPC ..... *B65D 83/64* (2013.01); *B65D 83/62* (2013.01); *Y10T 29/49* (2015.01)

(58) Field of Classification Search

USPC ..... 222/386, 386.5, 389, 394, 402.1

See application file for complete search history.

(56) References Cited

U.S. PATENT DOCUMENTS

| | | | | |
|---|---|---|---|---|
| 4,049,158 | A | 9/1977 | Lo et al. | |
| 4,182,688 | A | 1/1980 | Murtaugh | |
| 4,513,884 | A | 4/1985 | Magid | |
| 4,518,103 | A | 5/1985 | Lim et al. | |
| 5,040,704 | A | 8/1991 | Moran | |
| 5,285,931 | A | 2/1994 | Alfons | |
| 5,301,851 | A | 4/1994 | Frutin | |
| 5,340,483 | A * | 8/1994 | Payne et al. | 210/632 |
| 5,397,303 | A | 3/1995 | Sancoff et al. | |
| 5,398,850 | A | 3/1995 | Sancoff et al. | |
| 5,509,966 | A | 4/1996 | Sykes | |
| 5,522,228 | A * | 6/1996 | Guillot et al. | 62/101 |
| 5,553,741 | A | 9/1996 | Sancoff et al. | |
| 5,558,255 | A | 9/1996 | Sancoff et al. | |

(Continued)

FOREIGN PATENT DOCUMENTS

| | | |
|---|---|---|
| DE | 202006013146 U1 | 10/2006 |
| FR | 2723860 | 3/1996 |

(Continued)

OTHER PUBLICATIONS

John M. Thomas, "The existence of endothermic adsorption", Mar. 1961, J. Chem. Educ., p. 138.*

*Primary Examiner* — Patrick M Buechner
*Assistant Examiner* — Jeremy W Carroll
(74) *Attorney, Agent, or Firm* — Pepper Hamilton LLP

(57) ABSTRACT

A container for releasable pressurized gas or other active ingredient is provided. The container is packed with activated carbon loaded with adsorbed propellant. The container provides a replacement for the hydrocarbon or hydrofluorocarbon propellants currently used in aerosols, dusters and foghorns. A method for making such a replacement system is also provided.

18 Claims, 6 Drawing Sheets

(56) References Cited

U.S. PATENT DOCUMENTS

| | | | | | |
|---|---|---|---|---|---|
| 5,571,261 | A | | 11/1996 | Sancoff et al. | |
| 5,578,005 | A | | 11/1996 | Sancoff et al. | |
| 5,588,556 | A | | 12/1996 | Sancoff et al. | |
| 5,766,147 | A | | 6/1998 | Sancoff et al. | |
| 5,769,282 | A | | 6/1998 | Lane et al. | |
| 5,993,766 | A | * | 11/1999 | Tom et al. | 423/294 |
| 6,030,698 | A | * | 2/2000 | Burchell et al. | 428/315.5 |
| 6,164,492 | A | | 12/2000 | Lane et al. | |
| 6,309,446 | B1 | | 10/2001 | Nakanoya et al. | |
| 6,626,981 | B2 | * | 9/2003 | Wojtowicz et al. | 95/90 |
| 2005/0274737 | A1 | * | 12/2005 | Krause et al. | 222/105 |
| 2006/0054022 | A1 | * | 3/2006 | Hosoe et al. | 96/108 |
| 2006/0272537 | A1 | * | 12/2006 | Garrett | 102/367 |

FOREIGN PATENT DOCUMENTS

| | | |
|---|---|---|
| JP | 2003-008205 | 1/2005 |
| JP | 2005-008204 | 1/2005 |
| WO | 99/34897 | 7/1999 |
| WO | WO 2005-054742 | 6/2005 |
| WO | WO 2007-135438 | 11/2007 |

* cited by examiner

CARBON FILLED PRESSURIZED CONTAINER AND METHOD OF MAKING SAME

This application claims priority of U.S. Provisional Application Ser. No. 60/866,879 filed Nov. 22, 2006.

BACKGROUND

Hydrocarbon or hydrofluorocarbon gases are used for various applications such as refrigeration, air conditioning and aerosol propellancy to name a few. Hydrofluorocarbon (HFC) gases have very high Global Warming Potentials (GWPs) and usage of HFCs in aerosols is mostly limited to products which require non-flammable or non-toxic propellants. Many of these applications have already been targeted for phase-out within the European Union. For example, HFC-filled novelty aerosols, as exemplified by party horns or supporter horns, are to be prohibited in July 2009. Other specialised uses for HFCs include dusters for non-contact cleaning of debris from the surfaces of, for example, imaging or medical equipment, or sensitive materials, such as film and data storage media. Hydrocarbons are also used for releasing a product such as shaving gels or creams or generating a sound such as with noise makers or signalling horns. For marine and industrial safety, signalling horns are filled with hydrofluorocarbon propellant. Items containing hydrocarbon gases are prevalent in aerosol propellants. HFCs are still used in niche sectors of the market, such as in the industrial sector.

In use, however, these items can release undesirable and/or environmentally damaging vapors. To minimize such vapors, governmental authorities are considering restriction in the use of hydrocarbon and hydrofluorocarbon gases. Even where the propellant is contained in an aerosol can, and is not released to the environment during use, when the used can is disposed and the containment ruptured or oxidized, the propellant will be ultimately released to atmosphere. Further concerns of the hydrocarbons are that they are highly flammable, volatile organic compounds (VOCs). Hence, items employing hydrocarbon gas may be inherently dangerous, the inappropriate use of which can result in serious accidents and fatalities.

SUMMARY

In various embodiments the present invention is directed to a carbon filled pressurized container that provides an alternative to traditional pressurized containers which rely on hydrocarbons or hydrofluorocarbons for emissive and novelty aerosols and the like. In embodiments, the container is constructed with a first portion designed to hold carbon material charged with a gas that functions as the propellant at a pressure in the range of about 1 to 15 barg and a second portion designed to release gas from the adsorbed carbon material in the first portion. Alternatively, in embodiments, the first portion of the container contains carbon material charged by addition of solid carbon dioxide. In various embodiments, a bladder is installed in the first portion of the container and the second portion is designed for the discharge of a product from the bladder.

In various embodiments, the invention also provides a method of making a pressurized container comprising filling or partially filling a sealable container with activated carbon, introducing a propellant into the container for adsorption by the carbon, and, upon obtaining a sufficient pressure level, sealing the container. The propellant can be added by applying a stream of compressed gas. The stream of gas can be applied through a valve into the container. The carbon material may also be charged by addition of solid carbon dioxide.

Other embodiments, features, aspects and advantages of the present invention will become better understood or apparent from the following detailed description, drawings, and appended claims of the invention.

BRIEF DESCRIPTION OF THE DRAWINGS

The accompanying drawings illustrate examples of embodiments of the invention. In such drawings.

DESCRIPTION OF EMBODIMENTS OF THE INVENTION

Figure 1:
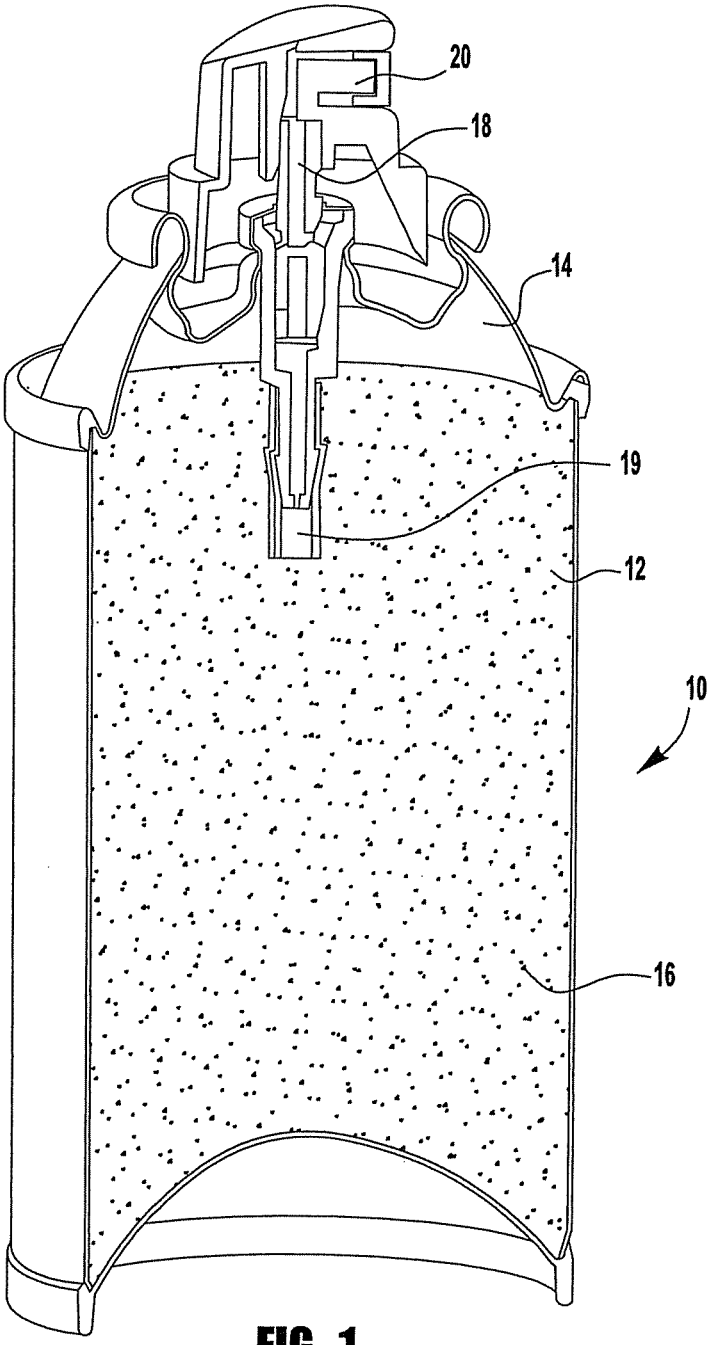
FIG. 1 illustrates an embodiment of a container according to aspects of the present invention.

As illustrated in FIG. 1, one embodiment of the present invention is in the form of a container 10 having a first portion 12 and second portion 14. The first portion 12 is adapted to contain carbon material 16 at a pressure in the range of about 1 to 15 barg. Carbon material 16 comprises an activated carbon that is charged with a propellant. The carbon can be charged by introducing a compressed gas or adding solid carbon dioxide to container 10. The propellant will "charge" the adsorbent to an effective pressure for desired application and depending upon the amounts and ratio of carbon to propellant.

The second portion 14 is formed in container 10 with a design that allows for the release of gas from carbon material 16. For instance, the release device may comprise a valve 18, integral with the second portion, extends into first portion 12 that is filled or substantially or partially full with carbon material 16, and connects to an actuator 20. Valve 18 is utilized to charge the carbon with a gas, or a solid form of the propellant may be introduced into the can (containing the carbon) before the valve is crimped to the can. The propellant may be air, oxygen, nitrogen, carbon dioxide, a noble gas or nitrous oxide, or a combination thereof. In examples, the propellant selected is carbon dioxide or nitrous oxide. Carbon dioxide is preferred because it is better environmentally. The carbon dioxide can be introduces either as a gas or a solid.

When it is desired to release gas from carbon material 16 in first portion 12 of container 10, valve 18 can be activated. The gas from container 10 will release to atmosphere. Movement of the valve will align the orifices on the valve stem to enable the gas to be released. Optionally, valve 18 is fitted with a valve dip tube and a filter device 19. The filter 19 can be a dust filter used to remove carbon dust from the dispensed gas. The filter 19 can remain in the container attached to the valve system. Although usually constructed from metal the container body may be made from glass, plastic, metal or any other material suitable for holding pressurized contents of the container 10. In examples, the container 10 is a foghorn or duster.

Figure 2:
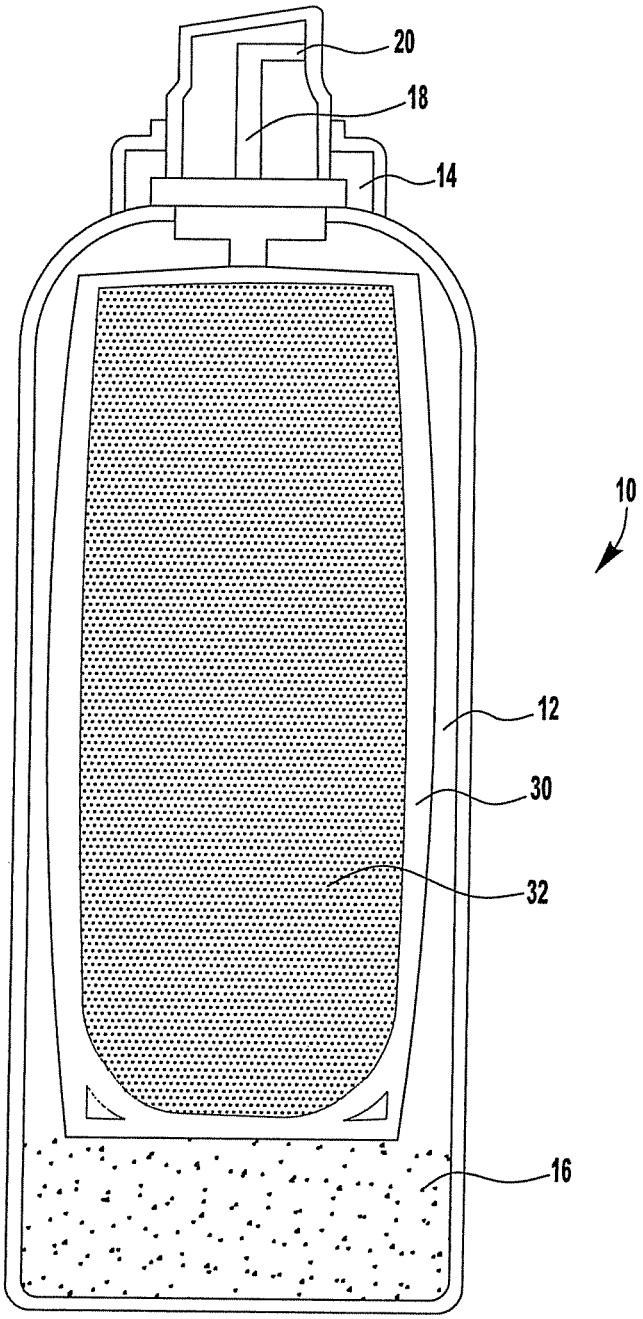
FIG. 2 illustrates an embodiment of a container having a bladder according to aspects of the present invention.
Figure 3:
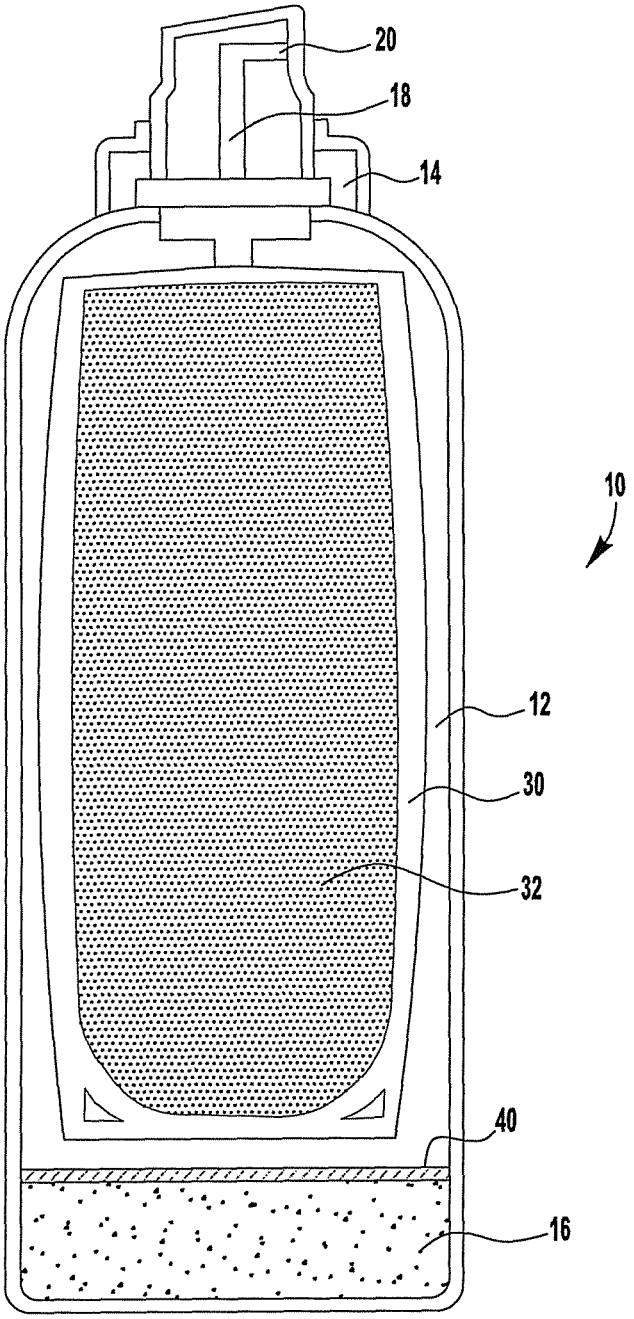
FIG. 3 illustrates another embodiment of a container having a bladder according to aspects of the present invention.

As illustrated in FIG. 2, another embodiment of the invention is in the form of a container 10 having a first portion 12 and a second portion 14 wherein the first portion 12 is further adapted to accommodate a bladder 30 in addition to carbon material 16 at a pressure in the range of about 1 to 15 barg. Bladder 30 is, for example, a bag such as a laminated aluminium bag, and can contain a product or other ingredient 32 which may be desired to be dispensed from the container 10. Suitable bags are those that have the strength and permeability characteristics appropriate for the product or active ingredient 32 (low permeability of $CO_2$ for example) such as a 3- or 4-pouch aluminized bag.

Second portion 14 is fit with a valve 18 that extends into the bladder 30 of the first portion 12. The valve 18 is in either male or female fitting. The valve 18 may be used to fill bladder 30 with a product or other ingredient 32 and subsequently gives a release channel for discharging ingredient 32 from container 10. The valve 18 operates for example by aligning holes or orifices on the valve stem such that the contents within its proximity in the bag can be released to the outside. In an example, the valve 18 is engaged by an actuator 20 that is situated at the top of the container 10. When release of the ingredient 32 is desired, actuator 20 is depressed causing the valve 18 to open allowing gas from carbon material 16 to expand. The valve 18 can be attached to a spring so that when the actuator 20 is released the valve returns to its original position. When the valve is opened, the pressure contained in the carbon material 16 and acting on the bladder 30 in turn forces the ingredient 32 to be dispensed from within the bladder 30. As a result, the volume of the first portion 12 that is occupied by the carbon/adsorbed material 16 expands. The actuator 20 is suited to the product dispensing requirements.

When the bladder is employed, no release of propellant (e.g., $CO_2$) or carbon occurs to the outside of the container 10 but the pressure will decrease a little because the volume that the gas occupies has increased at the expense of the reduced volume of the bladder as the ingredients are dispensed.

Optionally, an adsorbent pad 40 is positioned in first portion 12, in proximity to bladder 30, such as between bladder 30 and carbon material 16. Pad 40 can protect carbon material from product 32 in the event of leakage from bladder 30. Pad 40 is constructed of material appropriate for the adsorption of the specific product contained in the bladder 30.

According to aspects of the invention, carbon material 16 fills only the lower volume of first portion 12. An effective amount of carbon is used. The effective amount is that amount which is appropriate to achieve the desired pressure for anticipated use. The amount of carbon is a function of the desired initial pressure, the desired final pressure, the volume of the can and the volume of the bladder and given these parameters, the amount of carbon (and gas) can be calculated.

Carbon material 16 is prepared from one of a host of carbon sources including, among others, natural carbonaceous sources, such as peat, wood, coal, nutshell (such as coconut), petroleum coke, bone, and bamboo shoot, drupe stones and various seeds; and synthetic sources, such as poly(acrylonitrile) or phenol-formaldehyde. The carbon is activated to develop an intricate network of pores and surface area sufficient for adsorption. The pores have various sizes ranging from microporous to sub-microporous dimensions of molecular-sized entities. The larger transport pores provide access to the smaller pores in which most of the adsorption of propellant, such as gaseous species, takes place. Carbon activation is conducted with gaseous activation using steam, carbon dioxide or other gases at elevated temperatures, or chemical activation using, for example, zinc chloride or phosphoric acid. Other activation processes may be used to achieve the pore structure and surface area that provides an extensive physical adsorption property and a high volume of adsorbing porosity.

For embodiments of the invention, the activated carbon is prepared to contain a relatively high prevalence of micropores and a low enthalpy of adsorption. This is to enable a substantially maximum gas delivery. The size of the micropores ranges from about 0.5 nm to about 2.5 nm. In an embodiment, the micropores are about 1.0-2.0 nm. The enthalpy of adsorption is less than about 25 kJ (mole of adsorbate)$^{-1}$. In other words, a carbon with a high capacity uptake for the compressed gas and a low retention (or heel) on discharge provides for the maximum gas volume delivery. For a high uptake, the activated carbon has a high concentration of micropores. For a low retention, carbons with a low enthalpy of adsorption (for the particular gas) are selected as there is a relatively good correlation between these two variables. Unlike traditional dispensing systems that rely on adsorbed permanent gases, application of activated carbon in embodiments of the present invention enables propellant/gases to condense or immobilize resulting in increased gas storage and delivery capacity. Ordinarily, gas storage is accomplished by increasing the pressure in a fixed volume container and the amount of gas in the container, under non-extreme conditions, basically follows the ideal gas laws. Embodiments of the present container can physically deliver more gas than a non-carbon-filled container despite the volume lost to the carbon skeleton.

The activated carbon can be in a variety of forms, most commonly as powdered, granular or pelleted products. The activated carbon can also be in the form of a cloth, felt or fabric. In an embodiment, granules or pellets are used to decrease dust generation. Optionally, powder, or a combination of carbon forms is used. In addition, these forms come in a variety of sizes, which can affect the adsorption kinetics of the activated carbon. The base carbon, the activation process and the activated carbons' final form and size can all influence the material's adsorption performance.

According to aspects of the invention, the first portion 12 contains carbon material in the lower part, such as it is shown at the bottom of the can 10 in FIG. 2. The first portion 12 is adaptable for containing the carbon material 16 at a range of pressures. The specific pressure generally depends upon the characteristics of the product or ingredient 32 such as its viscosity or density and what the customer appreciates in a practical or aesthetic sense—it could be higher or lower pressure on discharge or a bigger or smaller flow, for example. The specific pressure is determined by using a weight combination of carbon and gas carbon dioxide that will yield a generally consistent discharge rate. A pressure gauge can be used to measure the actual pressure of container 10. The final pressure obtained on discharge of the container should be not too much less than the initial pressure. In most instances the pressure drop, $\Delta P$, should not exceed about 2 bar and in some instances less than about 1 bar is desired. The first portion 12 should contain a sufficient amount of charged carbon material 16 to provide a pressure and a flow rate from the can that is indiscernible for the user from start to finish.

Figure 5:
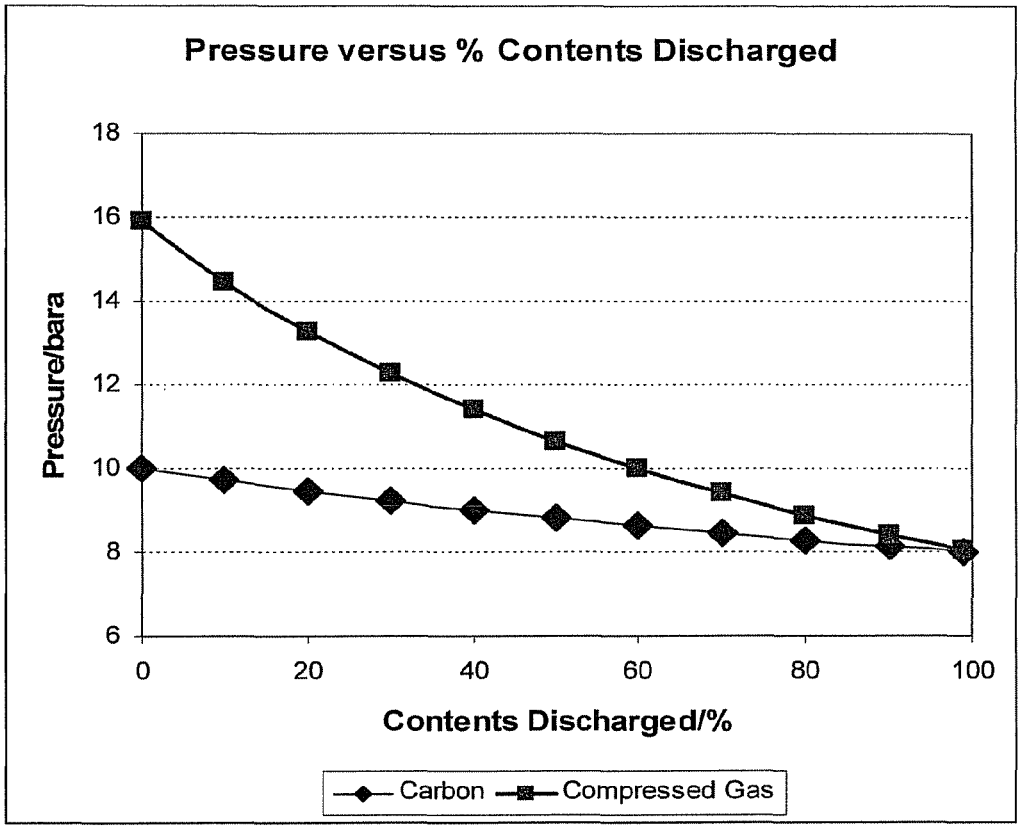
FIG. 5 illustrates a chart showing container pressures versus contents discharged for two containers.

Tests were conducted to determine appropriate pressures for container 10 as a function of the proportion of contents 32 discharged for both a container having activated carbon material according to aspects of the invention, and a container having only compressed gas. Results of the tests are plotted on the chart illustrated in FIG. 5.

Other start and finish pressures can be selected depending upon the volume of the can and bag, the quantity of carbon selected and the quantity of carbon dioxide. However, the principle is the same in each case: the effect of the carbon being to drastically reduce the pressure drop and to tend to make the pressure curve more horizontal.

In an example of the present invention, the container is designed to have a shape and size appropriate to accommodate a suitable pressure level for the select application. For example, the container may be packed with gas-loaded carbon to the maximum safety pressure limits dictated by the various regulations in force (for example, the European Transport Regulations). These limits may also be dictated by the design pressure of the can. When it is desired that the can contain relatively low pressures (compared to that for compressed gas without carbon), the container can be made from plastic material, for example, and molded into a square or rectangular or other convenient shape for efficient packing and transportation in bulk. Some applications use relatively low pressures. For example, soap and shave gel cans generally require 4 or 5 barg.

In an example, the same (maximum) pressure is used in the can whether it was adsorbed gas according to aspects of the invention or just compressed gas. The higher volume of gas obtainable from the adsorbed gas would enable use of a lower pressure. This would still produce more volume released than for the compressed gas. Thus, for a given pressure there is more gas volume from adsorbed gas than from compressed gas alone. The lower pressure might enable use of a plastic can if desired.

The container 10 can be designed to resemble that of a standard aerosol-type can fabricated from tin plate or aluminium. It can be of various sizes, shapes or designs. It can comprise bag-on-valve, bag-in-can or piston-operated devices. For example, container 10 provides a replacement for hydrocarbon propellants in the following way: the active ingredient 32 is enclosed inside a suitable bag 30 and gas adsorbed on the activated carbon is used to effectively squeeze the bag, or operate a piston, thereby dispensing the active ingredient 32. The active ingredient or product is stored in enclosure 30 separate from the carbon material 16. This is unlike conventional aerosols in which the propellant (i.e. hydrocarbon or hydrofluorocarbon) is generally mixed in with the active ingredient such that upon actuation the propellant is released to the environment along with the active product. Bladder 30 enables release of the active ingredient without the discharge of propellant because the activated carbon/gas material remains in first portion 12. The stored product or ingredients 32 can consist of any one or more of a variety of products including, among others, hairsprays, deodorants, insecticides, air fresheners, cleaning products, and so on, as well as materials of higher viscosities or different rheologies, such as adhesives, sealants, lubricants, mastics, paint, food products, and novelty products such as "silly string", etc.

Figure 4:
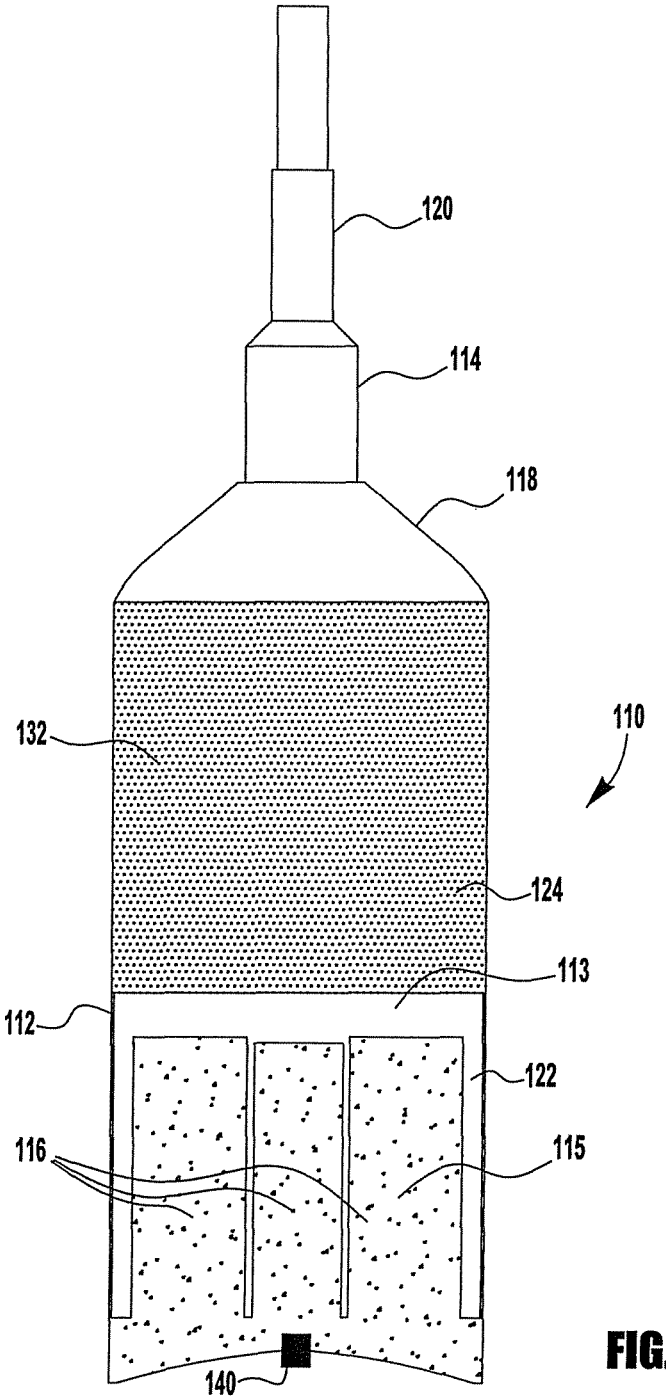
FIG. 4 illustrates an embodiment of a container having a piston according to aspects of the present invention.

In an embodiment of the invention the first portion 112 of container 110 has two chambers 122, 124 separated by a piston 113 as shown for example in FIG. 4. The first chamber 122 is designed to hold carbon material 116 charged with gas at a pressure in the range of about 1 to 15 barg, and further houses the propellant chamber 115. The propellant chamber 115 houses the adsorbed gas material 116 comprising the activated carbon and propellant. The second chamber 124 is designed to contain product or active ingredient 132. In an example, second chamber 124 contains sealant. The second portion 114 of container 110 is adapted with a valve housing 118 and delivery tube 120 for releasing ingredient 132 therefrom. Alternative mechanisms may be used for effective release of product 132.

Piston 113 generally provides an open cylinder having a hollow, cylindrical stem in the middle. There is a sufficiently wide gap between the hole at the base of the can and the bottom of the stem to permit introduction of the activated carbon and the solid $CO_2$ although the carbon and $CO_2$ can be introduced in other ways. For example, the carbon and $CO_2$ can be added before the plunger is inserted into the can. In that case there is no need for the can to contain a hole at its base. The appropriate amount of carbon/$CO_2$ propellant to add is the amount of charged carbon material 116 necessary to impose a pressure effective for releasing the ingredient 132 from the second chamber 124. In an example, the piston 113 is constructed out of a thick, strong, plastic material such as polypropylene. Other polymers could be used. Such a thick construction minimizes possible failure that could result from use of a lighter material (e.g., if a bag used in a bag-on-valve system were too thin for the selected pressure).

Operation of the valve housed within 118 releases ingredient 132. Gas charged on the carbon material 116 expands pushing piston 113 toward second portion 114 and the ingredient 132 out of the can (i.e., like discharging a medical syringe).

One method of making a pressurized container according to an embodiment of the present invention comprises filling or substantially filling a sealable container with activated carbon, applying a stream of compressed gas into the container for adsorption by the carbon, and, upon obtaining a sufficient pressure level, sealing the container. Gas is applied for adsorption into the carbon pores until reaching equilibrium pressure. For example, a regulated compressed gas cylinder may be connected to the can and admitted until the can reaches the regulated pressure. In another example, the can is exposed several times to the compressed gas regulated pressure such that each exposure brings it closer to the equilibrium pressure. Gas or compressed gas can be added through a valve into the container. The compressed gas is selected based on its affinity for the carbon. Different gases provide different uptakes, different heels and hence different deliverable volumes of gas because of the different interaction potentials between the adsorbed vapour and adsorbent.

A method for making a pressured container according to aspects of the invention involves filling the container with the carbon, adding solid $CO_2$, inserting a bag-on-valve into the container and crimping the bag-on-valve on the container. For example, this is accomplished by use of a device which forces the ring piece containing the valve on to the neck of the can and crimping the two together. The can is then assembled ready to allow the active ingredient to be charged through the valve.

The gas can be added by applying a stream of compressed gas or a liquid or a solid into the container for adsorption by the carbon.

Example 1

A typical air duster was tested for comparison with an embodiment of the present invention. The typical duster comprised of a container having a 513 $cm^3$ capacity and containing 300 $cm^3$ of liquefied HFC 134a. The volume of liquid and the design of the can were set to ensure the delivery of only HFC vapour. Thus when the can valve was depressed no liquid was dispensed—even when the can was inverted. The length of the valve dip tube was positioned to reside above the liquid level. By completely dispensing the duster, it was determined to contain a liquid volume sufficient to generate about 85 liters of 134a vapour measured at ambient temperature and pressure. This amount is equivalent to about 360 grams of HFC 134a being directly emitted to the atmosphere. The $CO_2$ global warming potential (GWP) of HFC 134a is 3,200 (over a 20 year span). Thus, 360 g of 134a is equivalent to 1,152,000 g (i.e. more than a ton of carbon dioxide per can over this timescale).

In an example of the present invention, an air duster container of similar dimension and design as the typical air duster above was filled with 500 $cm^3$ of activated carbon and charged with carbon dioxide to reach a pressure of about 10 barg. The quantity of carbon dioxide was 93 g (approximately 52 liters of gas). Filling the carbon-containing can with carbon dioxide may be achieved by using either compressed gas (or by adding a weight of solid carbon dioxide calculated to achieve the required pressure). The filled container delivered a total gaseous volume of 42 liters of discharge before the pressure of the container reached atmospheric pressure. This compared with only 5 liters of delivered gas from the same sized container charged with 10 barg of carbon dioxide, without carbon. The test results indicated there are more "blasts" of air per container from a container filled with carbon loaded with compressed gas than a container containing only compressed gas. The results for both a solid and gas propellant were generally the same for a given mass. Greater or lesser quantities of activated carbon can be employed, or greater or lesser fill pressures can be used with consequential changes to the total gas volume. The gas-loaded, carbon-filled container, in this example, delivered fewer blasts per container when compared to the typical "air" duster charged with HFC 134a. It delivered 42 liters of discharge compared to 85 liters of vapour discharged from the typical HFC air duster. The number of blasts can be increased by enlarging the can volume and/or by increasing the container pressure in a higher pressure-rated can. In this example, it is contemplated that doubling the volume of the container would compensate for the shortfall and yield an equivalent number of blasts.

Example 2

Figure 6:
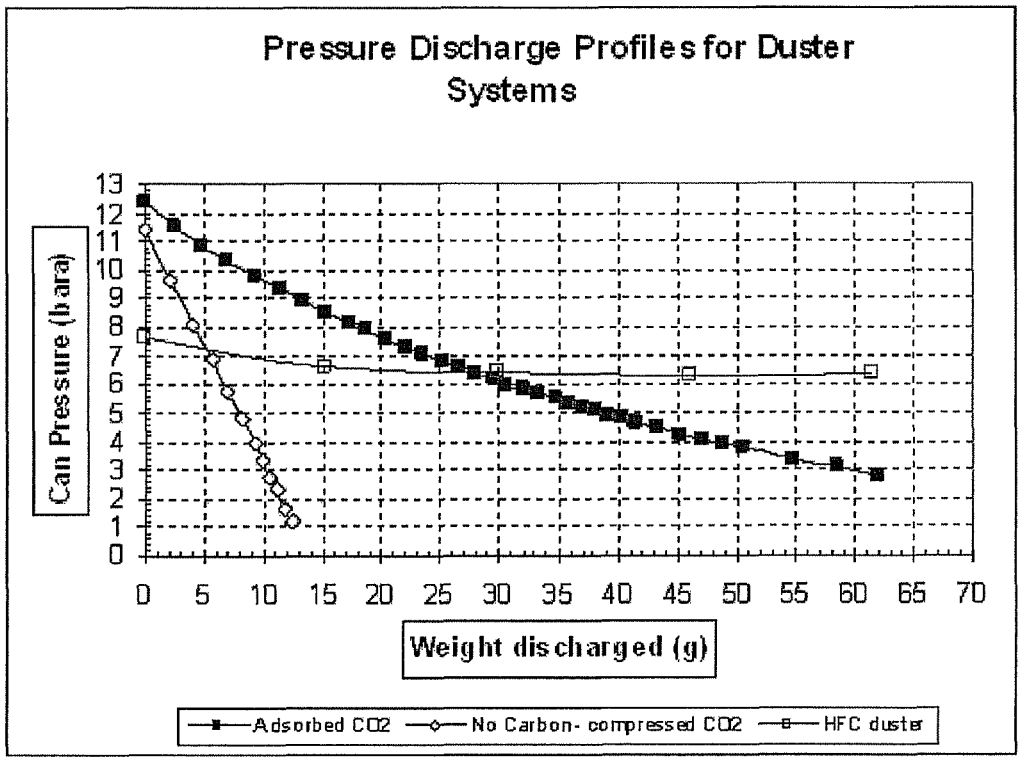
FIG. 6 illustrates a chart showing pressure discharge profiles for three duster systems.

Tests were run to compare the efficiencies of compressed carbon dioxide gas, adsorbed carbon dioxide, and a typical, commercially-manufactured HFC duster. Containers of similar type and volume were charged to about 10 barg pressure with compressed carbon dioxide and adsorbed carbon dioxide. Pressure measurements on each container were recorded at standard temperature. Gas was discharged from each by depressing its actuator for five seconds at a time. The weight loss of gas was recorded and the containers were then allowed to thermally equilibrate to 25° C. in a thermostatically controlled water bath. The process was repeated until the pressure profile of each container could be ascertained. The pressure/discharge profiles for each are illustrated in the chart in FIG. 6.

The rapid pressure drop of the compressed gas canister that accompanied each 5 second blast clearly demonstrates its ineffectiveness. At the other extreme, the HFC duster displayed a fairly constant pressure value, following equilibration, until all of the HFC liquid was depleted, at which stage the pressure rapidly decayed on subsequent discharges. By comparison the container of adsorbed carbon dioxide enabled a greater number of effective blasts before the pressure diminished to a level that would no longer be functional.

The number of effective blasts in the adsorbed system is a function of the valve type. In particular, it is a function of the number and effective area of the orifice(s) on the valve stem. A larger area will deliver a more powerful blast than a smaller area but will also deplete the can more quickly because a greater quantity of gas will be discharged per blast. Different valve types were compared. They gave similar curves to the one illustrated.

The kinetic energy of a gas is given by the formula ½ $mv^2_{rms}$, where $v_{rms}$ denotes the root mean square velocity of the molecules comprising the gas. For practical purposes, $v_{rms}$ can be substituted by the superficial linear velocity, defined as the volumetric flowrate divided by the area of the valve orifice(s). For the HFC duster, the kinetic energy of a 1 second blast (equivalent to the power of the blast) can be determined from the mass discharged per unit time and the area of the valve orifice. For the typical duster used in the example this equates to a value of 40 watt. A plot of the blast power of the can containing the adsorbed carbon dioxide (fitted with the same sized valve) as a function of the number of blasts gives a smooth curve that can be fitted to the expression: $P=738.5\ n^{-1.912}$, where P is the power and n is the number of blasts ≥40 watt. Substituting P=40 and solving for n, in this example, indicates the potential for 25×1 s blasts. The value of 40 watt for the adsorbed $CO_2$ canister corresponds to about 3 barg.

By regulating the pressure of the container storing the adsorbed carbon dioxide using a valve and flow through a regulator to around 3 barg a further 75×1 s equal-power blasts may be realised.

Example 3

A commercially available gas horn (aka fog horn, party horn or supporter horn) can (260 $cm^3$) was found to contain 75.4 g of a highly flammable propane/butane mixture (operating at a pressure of 6.7 bara at ambient temperature). The total gas volume available in the can was estimated to be 38 liters. Inversion of the can and actuation of the valve caused liquid hydrocarbon to be copiously ejected through the horn and operation in the normal, upright mode emitted hydrocarbon vapour.

A can of similar volume was filled with activated carbon and pressurised to 10 barg with carbon dioxide. The can delivered a volume of gas of 21.8 liters. Quantities of activated carbon can be employed or greater or lesser fill pressures can be used with consequential changes to the total gas volume. Alternatively, the can may be charged with solid carbon dioxide and the remaining volume filled with a weight of solid carbon designed to give the final resulting pressure.

Cans containing carbon dioxide adsorbed onto activated carbon, each charged with 9.5 barg pressure, were prepared fitted with two different sized valves. The measurement of the loudness of the emitted sound was carried out using a Tenma (72-860) sound level meter placed at a distance of approximately 2 m from the source.

At the above distance the smaller-sized valve had an initial sound level of about 105 dB and the larger valve gave an initial sound level of about 125 dB. For comparison, a commercial 650 ml "air" duster, known as a Sprayduster (filled with hydrofluorocarbon), and a commercial 260 ml fog horn, known as a party horn FOGO (filled with hydrocarbon mixture), were compared with two 650 ml sized cans filled with carbon (307 g) and $CO_2$ (98 g). The first adsorbent can was fitted with a small sized valve and the second can was fitted with a larger sized valve. The commercially manufactured HFC canister gave a reading of 118 dB and a hydrocarbon-filled party horn gave 112 dB.

Gas was periodically discharged from the activated carbon/carbon dioxide-containing cans by release through the actuator and the pressure recorded prior to measurement of the sound level. Using the trial horn, the measured sound from the smaller-sized valve was determined to be at a constant level until a pressure of about 5 barg was attained. Thereafter the sound levels were noted to fall slightly until, at a pressure of 2.8 barg, the horn was judged to be ineffective. In the case of the larger valve, sound levels were again constant to about 5 barg. Subsequently, the sound levels were measured to fall gradually, reaching 107 dB at 0.2 barg.

Example 4

Aerosol cans containing carbon and $CO_2$ as a replacement for hydrocarbon or hydrofluorocarbon propellants were prepared by the following procedure:

This method of filling the aerosol can, using the solid form carbon dioxide, can be more efficient than filling with compressed gas because it requires no gas flushing. Only one addition of carbon dioxide was required with the heat generated by the adsorption process being effectively nullified by the heat required for the sublimation of the solid refrigerant. By comparison, with compressed gas the can was subjected to an over pressure due to the heat generated from the adsorption process. The resulting heat evolution counteracts the degree of adsorption that can be achieved and the can has to be subsequently cooled and re-charged with the gas so that the maximum quantity of carbon dioxide can be taken up by the activated carbon. There are many commercially available systems that can be employed to efficiently and practically generate solid carbon dioxide from a gaseous source of this gas. In the examples described here, solid $CO_2$ was generated from a compressed gas cylinder fitted with a dip-pipe such that when the cylinder valve was opened, liquid carbon dioxide was discharged through a laboratory-scale pellet maker.

An experimentally-based model was used to calculate the initial and final pressures for carbon loaded materials having varied amounts of carbon and carbon dioxide for a container size of 210 $cm^3$ using a high activity coconut shell-based activated carbon and for about 75 $cm^3$ of active ingredient. The experimental results based on these calculations are illustrated in the following table.

| Can Ref. | Carbon weight (g) | CO2 weight (g) | Initial Pressure (bara) | Water added (ml) | Final Pressure (bara) | ΔP/bar (22° C.) | ΔP/bar (25° C.) |
|---|---|---|---|---|---|---|---|
| 1 | 22.90 | 8.70 | 6.80 | 76.34 | 8.70 | 1.90 | |
| 2 | 18.31 | 4.64 | 3.88 | 76.27 | 4.76 | 0.88 | |
| 3 | 22.94 | 9.53 | 7.79 | 75.11 | 9.70 | 1.90 | |
| 4 | 30.10 | 9.30 | 5.61 | 74.40 | 6.74 | 1.13 | |
| 5 | 25.01 | 9.53 | 6.86 | 76.65 | 8.98 | 2.12 | |
| 6 | 30.00 | 11.56 | 8.01 | 76.90 | 9.54 | 1.53 | |
| 7 | 30.00 | 11.01 | 8.33 | 77.18 | 9.31 | 0.98 | |
| 8 | 30.00 | 10.37 | 7.31 | 77.00 | 8.78 | 1.47 | |
| 9 | 30.00 | 10.50 | 6.99 | 77.01 | 8.46 | 1.47 | |
| 10 | 30.00 | 10.52 | 7.06 | 76.83 | 8.49 | 1.43 | |
| 11 | 15.00 | 6.23 | 6.43 | 77.11 | 8.09 | 1.66 | |
| 12 | 15.00 | 6.50 | 6.71 | 77.02 | 8.68 | 1.96 | |
| 13 | 18.34 | 4.50 | 3.88 | 76.27 | 4.76 | 0.88 | |
| 14 | 18.30 | 4.55 | 3.65 | 76.99 | 4.34 | 0.69 | |
| 15 | 18.30 | 5.00 | 4.16 | 76.99 | 4.85 | 0.69 | |
| 16 | 18.30 | 5.00 | 4.28 | 77.03 | 5.21 | | 0.93 |
| 17 | 18.30 | 4.55 | 3.81 | 76.99 | 4.54 | | 0.73 |
| 18 | 18.30 | 5.01 | 4.35 | 76.99 | 5.08 | | 0.73 |
| 19 | 18.30 | 5.00 | 4.28 | 77.03 | 5.21 | | 0.93 |
| 20 | 15.00 | 6.23 | 6.43 | 77.11 | 8.09 | 1.66 | |
| 21 | 15.00 | 6.23 | 6.63 | 77.11 | 8.43 | | 1.81 |
| 22 | 15.00 | 6.50 | 6.71 | 77.02 | 8.68 | 1.96 | |
| 23 | 15.00 | 6.50 | 6.99 | 77.02 | 9.09 | | 2.1 |
| 24 | 13.00 | 6.22 | 7.01 | 77.02 | 8.91 | 1.89 | |
| 25 | 13 | 6.21 | 7.32 | 77.02 | 9.30 | | 1.98 |

A pre-determined quantity of activated carbon was added to a commercially available container followed by a predetermined weight of carbon dioxide. The quantities were selected based on the table below. A bag equipped with a valve (e.g. a bag-on-valve) was inserted into the container. The container was then crimped. The resulting assembly is then ready for filling with active ingredient and the appropriate actuator applied. The actuator to be applied depends upon the subsequent use of the aerosol can and the form of dispensation required, for example spray or stream.

For a given set of conditions the more carbon that is used, the lower the pressure drop from the initial to the final pressure.

To protect against a mechanical failure of the bag 30 during the filling procedure or during consumer use, an absorbent pad 40 may be optionally inserted into the container. In an example, pad 40 is, among others, a cotton or synthetic adsorbent, such as a diaper material. Pad 40 has a depth of about 1 cm sized to fit within the perimeter of first portion 12 and is placed on top of the carbon underneath the bag. In the event the bag would puncture, its contents (likely liquid contents) would be exposed to the activated carbon adsorbent pad and be absorbed thus effectively preventing its contact with the activated carbon. Otherwise it is possible that some carbon dioxide could be displaced from the activated carbon with a concomitant increase in the pressure inside the can. Where the solvent is water based, or part water based, it is convenient to use a starch-based water absorbent such as is commonly used in diapers although other absorbent materials can be employed.

Example 5

In the example which follows, a can containing carbon and carbon dioxide was prepared such as to provide an initial pressure of between 4.2 and 4.4 bara. The addition of 77 $cm^3$ of water caused the pressure inside the can to rise to a maximum of 10.2 bara. Into another similarly-filled can was inserted a disc of the starch-based absorbent which was placed on top of the activated carbon such as to reasonably allow the liquid ingress to contact the disc without undue contact of the carbon. Addition then of 77 $cm^3$ of water caused the pressure inside the can to rise to a maximum of 5.4 bara, measured at 25° C. This was approximately 5 bar lower than the can prepared without the absorbent disc Example 6

In an embodiment of the present invention, a container filled with activated carbon/$CO_2$ and fitted with a proprietary gap-failing, industrial sealant was tested to demonstrate effective ingredient dispensation from a 'bag-in-can' system. The can volume was nominally 330 $cm^3$ and contained about 222 $cm^3$ (270 g) of the sealant held in an integrated bag-in-can system. A rubber valve in the can base sealed the hydrocarbon mixture.

The carbon material was prepared by first calculating appropriate weights of granular activated carbon and solid carbon dioxide needed to produce a full can pressure of 7 bara and a fully discharged can pressure of 5 bara. Experimentally based isotherms for the activated carbon, other gas measurements, and the operating temperature may be relevant to determining weight ratios. In an example, 25 degrees C. was used to determine that a carbon weight of 32.3 g and a $CO_2$ weight of 9.1 g would achieve the required pressures with this particular configuration.

The following method was undertaken:—

(i) A can of sealant (containing hydrocarbon propellant) was initially weighed.

(ii) The plug in the can base was slowly and carefully removed from the base hole and the hydrocarbon propellant mixture was allowed to slowly vent from the can hole. (The weight loss of hydrocarbon was recorded as 12.6 g)

(iii) The 'empty' space volume within the vented can was determined by slow introduction of a measured volume of water through the base hole until the empty space within the can was filled. The volume of water to fill the 'empty' space was =108 $cm^3$. The added water was drained from the can base and the space volume allowed to dry.

(iv) To achieve the initial pressure of 7 bara in the can, the calculated weight of activated carbon (32.3 g) was added to the can void space through the small hole in the base. A calculated weight of solid $CO_2$ (9.1 g) was then added to the weighed carbon via the base hole. When the weight of solid $CO_2$ required was achieved, a Nicholson plug was quickly inserted to seal the base hole in the can.

(v) After 20 minutes equilibration to achieve ambient temperature conditions, a trial dispensation of sealant through the top valve fitment was considered as successful with a steady, even and manageable flow of the ingredient throughout the dispensation. An effectively complete discharge of 267 g of sealant was achieved. On destructive opening of the can it was observed that the sealant bag was completely discharged.

In an example of an embodiment of the present invention, it is anticipated that another propellant could be substituted, such as air, oxygen, nitrogen, carbon dioxide or a noble gas (argon, for example) or a mixture of these gases. Other, less environmentally benign gases, such as nitrous oxide, adsorbed on activated carbon, could also be used as a substitute for the hydrocarbon or hydrofluorocarbon propellant and may be a desirable change to make on health, safety and environmental grounds.

Example 7

A commercial, viscous sealant comprising trimethoxyvinyl silane and contained in a can 110 of approximately 150 $cm^3$ capacity was found to be designed to operate using a piston device 113 as shown in FIG. 4. The discharge operating pressure of the can was measured at about 4.9 barg. The snug-fitting piston was observed to effectively separate the sealant from the hydrofluorocarbon propellant and was of robust plastic construction. The can was therefore effectively separated into two chambers; the first of which, housing the propellant, was of about 50 $cm^3$ capacity; and the second of which, containing the sealant, was of about 100 $cm^3$ capacity. A rubber plug insert was removed from the circular hole located at the base of the can and the HFC propellant (approximately 4 g) released to atmosphere.

According to aspects of the invention, the propellant chamber 115 was part-filled with carbon material 116 comprised of calculated quantities of activated carbon and solid carbon dioxide, by means of the hole at the base of the can, and the rubber plug 140 was re-inserted. The quantities of activated carbon and carbon dioxide were calculated using the aforementioned model such as to give a starting pressure in the region of 6-7 bara and a final pressure on full discharge of 5 bara (pressures measured at 25° C.)). Upon operation of the release valve of the second portion 114, gas expanded in the first chamber 112 pushing piston 113 against the second chamber 124 releasing product 132 from release portion 114. The resulting can was noted to give a complete discharge of the product 132, such as sealant in this case, with a very satisfactory and controlled flowrate. The following table shows the calculated start and finish pressures for a number of variables, including: various volumes of ingredient, propellant chamber volumes, carbon weights and $CO_2$ weights.

| Ingredient Volume/ $cm^3$ | Propellent Chamber Volume/ $cm^3$ | Activated Carbon Weight/ g | $CO_2$ Weight/ g | Start Pressure/ bar | Finish Pressure/ bar | ΔP/ bar |
|---|---|---|---|---|---|---|
| 100 | 47 | 16.18 | 4.88 | 7.0 | 5.2 | 1.8 |
| 100 | 47 | 13.41 | 4.15 | 7.0 | 5.0 | 2.0 |
| 100 | 47 | 18.37 | 5.19 | 6.5 | 5.0 | 1.5 |
| 100 | 47 | 11.10 | 3.36 | 6.5 | 4.5 | 2.0 |
| 100 | 47 | 15.35 | 4.18 | 6.0 | 4.5 | 1.5 |
| 90 | 47 | 19.27 | 5.70 | 7.0 | 5.5 | 1.5 |
| 75 | 47 | 19.43 | 5.74 | 7.0 | 5.7 | 1.3 |
| 50 | 47 | 17.77 | 5.31 | 7.0 | 6.0 | 1.0 |
| 100 | 100 | 35.13 | 10.58 | 7.0 | 6.0 | 1.0 |

-continued

| Ingredient Volume/ $cm^3$ | Propellent Chamber Volume/ $cm^3$ | Activated Carbon Weight/ g | $CO_2$ Weight/ g | Start Pressure/ bar | Finish Pressure/ bar | ΔP/ bar |
|---|---|---|---|---|---|---|
| 200 | 100 | 31.95 | 9.73 | 7.0 | 5.2 | 1.8 |
| 250 | 100 | 41.61 | 12.29 | 7.0 | 5.2 | 1.8 |

The embodiments of the invention shown and described above and in the figures and examples are exemplary of numerous embodiments that may be made within the scope of the invention. It is to be understood that the detailed embodiments, figures and examples are presented for elucidation and not limitation. The invention may be otherwise varied, modified or changed within the scope of the invention as defined in the appended claims.

What is claimed is:

1. A container for releasing pressurized contents comprising:

a first portion, a second portion defining a release device for the first portion, and a carbon material contained in the first portion wherein said carbon material comprises activated carbon charged with a propellant selected from the group consisting of air, oxygen, nitrogen, carbon dioxide, a noble gas and nitrous oxide, or a combination thereof to give a pressure of about 1 to 15 barg, wherein said activated carbon contains micropores having sizes in the range of about 0.5 nm to about 2.5 nm and has an adsorption enthalpy of less than 25 kJ(mole of adsorbate)$^{-1}$.

2. The container of claim 1, wherein said activated carbon is derived from a natural source.

3. The container of claim 1, wherein said propellant is a compressed gas.

4. The container of claim 1, wherein said propellant is introduced in the form of solid carbon dioxide.

5. The container of claim 1, wherein said activated carbon fills or substantially fills said first portion.

6. The container of claim 1, wherein said container is in the general form of a cylinder, cube or rectangular box.

7. The container of claim 1, further comprising a bladder disposed in said first portion.

8. The container of claim 7, wherein said bladder contains a product to be dispensed from said container.

9. The container of claim 7, further comprising an adsorbent positioned in proximity to said bladder.

10. The container of claim 1, further comprises a product to be discharged.

11. The container of claim 1, wherein the product to be discharged is a viscous material.

12. The container of claim 1, wherein the amount of activated carbon and propellant is determined to maintain less than or equal to a 2 bara pressure drop between the initial dispensing pressure and a final dispensing pressure.

13. The container of claim 1, wherein said activated carbon is derived from a synthetic source.

14. A container for discharging product comprising:

a first chamber;

a second chamber disposed adjacent the first chamber and adapted to receive a product;

a release mechanism designed to fit with the second chamber and selectively discharge product therefrom;

a carbon material disposed in the first chamber, wherein said carbon material is activated carbon charged with a propellant to give a pressure of about 1 to 15 barg and wherein said activated carbon contains micropores having sizes in the range of about 0.5 nm to about 2.5 nm and has an adsorption enthalpy of less than 25 kJ(mole of adsorbate)$^{-1}$; and a piston positioned between the first chamber and the second chamber and to move toward the release mechanism upon expansion of gas in the first chamber to pressurize the second chamber to release product therefrom.

15. The container of claim 14, wherein the propellant is introduced in the form of solid carbon dioxide or compressed gas or a combination thereof.

16. The container of claim 14, further comprises a product to be discharged.

17. The container of claim 14, wherein the product to be discharged is a viscous material.

18. The container of claim 14, wherein the amount of activated carbon and propellant is determined to maintain less than or equal to a 2 bara pressure drop between the initial dispensing pressure and a final dispensing pressure.

* * * * *